US007568268B2

(12) United States Patent
Fahrnbauer et al.

(10) Patent No.: US 7,568,268 B2
(45) Date of Patent: Aug. 4, 2009

(54) METHOD FOR PRODUCING AN ELECTRICALLY CONDUCTIVE CONNECTION AND A CONTACT ELEMENT PROVIDED WITH AN ELECTRIC CONNECTION SO PRODUCED

(75) Inventors: Bernhard Fahrnbauer, Munich (DE); Robert Albiez, Reichertshofen (DE); Hartmut Roloff, Reichertshausen (DE); Dieter Dinkel, Mainburg (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 159 days.

(21) Appl. No.: 11/418,266

(22) Filed: May 5, 2006

(65) Prior Publication Data

US 2006/0289195 A1 Dec. 28, 2006

Related U.S. Application Data

(63) Continuation of application No. PCT/EP2004/010831, filed on Sep. 28, 2004.

(30) Foreign Application Priority Data

Nov. 6, 2003 (DE) ..... 103 52 325

(51) Int. Cl.
*B21C 47/00* (2006.01)

(52) U.S. Cl. ..... 29/33 B; 29/34 D; 29/514; 29/860; 174/129 R; 174/75 C; 219/56.22; 219/91.2

(58) Field of Classification Search ..... 29/33 B, 29/34 R, 34 D, 564.4, 564.3, 564.2, 505, 29/514, 860, 861, 862, 863, 864, 865, 866, 29/867; 174/74 R, 84 C, 90, 93, 128.1, 129 R, 174/133 R, 75 C, 78; 129/85.16, 56.22; 219/56.1, 219/91.2, 85.16, 56.22
See application file for complete search history.

(56) References Cited

U.S. PATENT DOCUMENTS 3,499,101 A * 3/1970 Hogendobler et al. ..... 174/75 C (Continued)

FOREIGN PATENT DOCUMENTS

DE 41 17 696 C1 10/1992

(Continued)

OTHER PUBLICATIONS

International Search Report dated Jan. 31, 2005.

(Continued)

*Primary Examiner*—David P Bryant
*Assistant Examiner*—Eric A. Gates
(74) *Attorney, Agent, or Firm*—Crowell & Moring LLP

(57) ABSTRACT

A method is provided for producing an electrically conductive connection between a contact element interacting with a corresponding counter-contact and several electric lines, each of which consists of several wires. The method consists of placing the lines on a contact element supporting surface, controlling the lines integrity, and fixing the lines to the contact elements by resistance welding. In particular, the contact element is provided with crimping elements which surround and/or form a ground cable terminal screwed to a mass bolt.

8 Claims, 1 Drawing Sheet

U.S. PATENT DOCUMENTS

| | | | | | |
|---|---|---|---|---|---|
| 3,812,424 | A * | 5/1974 | Abbe | 324/688 |
| 3,884,726 | A * | 5/1975 | Landecker | 136/203 |
| 4,659,991 | A * | 4/1987 | Weischedel | 324/241 |
| 4,864,236 | A * | 9/1989 | Gibson et al. | 324/238 |
| 5,036,277 | A * | 7/1991 | van der Walt | 324/235 |
| 5,061,827 | A * | 10/1991 | Grabbe | 174/75 C |
| 5,594,980 | A * | 1/1997 | Tamura et al. | 29/33 M |
| 5,660,742 | A * | 8/1997 | Warner et al. | 219/85.16 |
| 5,808,260 | A * | 9/1998 | Asakura et al. | 219/56.22 |
| 5,823,825 | A * | 10/1998 | Murphy | 439/610 |
| 6,184,471 | B1 * | 2/2001 | Asakura et al. | 174/78 |
| 6,239,377 | B1 * | 5/2001 | Nishikawa | 174/110 R |
| 6,265,664 | B1 | 7/2001 | Sakaguchi et al. | |
| 6,452,101 | B1 | 9/2002 | Haramaki et al. | |
| 6,521,069 | B1 * | 2/2003 | Sugaya et al. | 156/89.16 |
| 6,643,926 | B2 * | 11/2003 | Sakaguchi et al. | 29/863 |
| 2001/0020540 | A1 | 9/2001 | Sakaguchi et al. | |

FOREIGN PATENT DOCUMENTS

| | | |
|---|---|---|
| DE | 199 35 933 A1 | 3/2000 |
| FR | 2 792 270 | 10/2000 |
| JP | 55-113279 | 9/1980 |

OTHER PUBLICATIONS

German Search Report dated Mar. 20, 2006.

* cited by examiner

METHOD FOR PRODUCING AN ELECTRICALLY CONDUCTIVE CONNECTION AND A CONTACT ELEMENT PROVIDED WITH AN ELECTRIC CONNECTION SO PRODUCED

CROSS-REFERENCE TO RELATED APPLICATIONS

This application is a continuation of PCT Application No. PCT/EP2004/010831 filed on Sep. 28, 2004, which claims priority to German Application No. 103 52 325.1 filed Nov. 6, 2003, the disclosures of which are incorporated by reference herein.

BACKGROUND AND SUMMARY OF THE INVENTION

The invention, on the one hand, relates to a method of producing an electrically conductive connection between a contact element, which interacts with a corresponding counter-contact element, and several electric lines, each consisting of several stranded wires, and, on the other hand, to a contact element produced in such a manner.

Such contact elements are produced particularly for mechanically highly stressed applications, as in the case of a motor vehicle, as a rule, by means of a crimping process. In this case, crimping elements molded onto the contact element are pressed together at a high pressure until they are connected with the contact element in a contact-making manner. Particularly when designed for a long-time operation, this process creates some uncertainty. When used, for example, for a grounding connection, this uncertainty is noticeable as transient, not always reproducible interruptions of the grounding connection. It may also occur that an electric line is absent or is pulled at the free end out of the contact area, for example, by a subsequent stripping operation.

It is an object of the invention to provide a method by which a contact element of the above-mentioned type is completely produced in a reliable and durable manner. In an advantageous application of the method, the contact element should be mechanically additionally particularly loadable and/or usable as a ground cable socket.

The solution of this task is achieved by a method of producing an electrically conductive connection between a contact element, which interacts with a corresponding counter-contact element, and several electric lines, each consisting of several stranded wires. The lines are deposited on a plane supporting surface of the contact element. The completeness of the lines is checked, and subsequently, the lines are fixed by use of a resistance welding operation in a contact-making manner on the contact element. Contact elements which have the indicated special characteristics are provided, wherein the supporting surface additionally has two crimping elements which surround the lines. The contact element may be constructed as a ground cable socket which is held on a ground bolt by way of a screwed connection.

A flat supporting surface in the sense of the invention means that it is planar or a contour rounded in its cross-section whose radius is significantly larger than the radius of the attached lines. By means of the targeted shaping of the cross-section, the process reliability of the welding operation can clearly be increased, because, before, during and after the welding operation, the cross-section corresponds to defined data and the entire process thereby becomes precisely controllable. The examination of the completeness of the lines before the actual welding operation ensures that the welding operation will be carried out only if all provided lines are present. Finally, the resistance welding operation provides a long-term-stable and electrically well-conducting connection of the lines with the contact element.

Advantageous further developments of the invention are described and claimed herein.

Other objects, advantages and novel features of the present invention will become apparent from the following detailed description of the invention when considered in conjunction with the accompanying drawings.

DETAILED DESCRIPTION OF THE DRAWING

Figure 1:
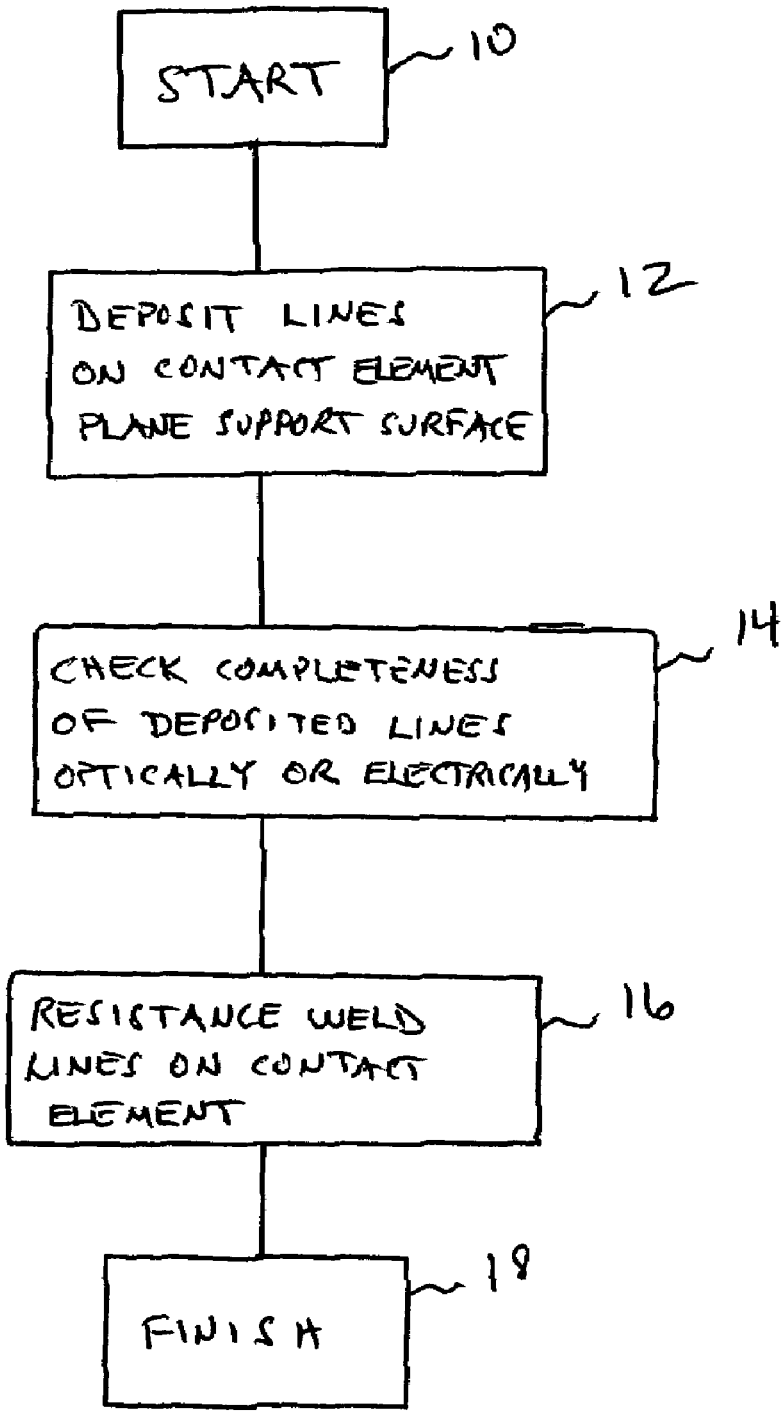
FIG. 1 is a flow chart illustrating the method of producing an electrically conductive connection in accordance with the present invention.

Referring to FIG. 1, there is shown a flow chart illustrating the operation of the method of producing an electrically conductive connection between a contact element, which interacts with a corresponding counter-contact element, and several electrical lines, each including several stranded wires. After starting 10, the method operates by depositing the lines on a plane supporting surface of the contact element 12. Then, it is checked whether the lines have been completed 14. This check may be determined optically and/or electrically. Subsequently, the lines are fixed by use of a resistance welding operation in a contact-making manner on the contact element 16. Thereafter, the method finishes 18.

A rectangular cross-section of the lines may be produced by use of simple devices. Two laterally applicable forming elements, in conjunction with a final forming element having a straight cross-section, are particularly suitable for this purpose. The forming of the cross-section of the lines can take place after the lines were deposited on the supporting surface or, in a preparatory fashion, in a separate machining step before the depositing operation. In this case, the cross-section of the conductor bundle already has at least approximately the desired shape.

A particularly simple and reliable possibility of checking the completeness of the lines consists of determining the cross-section formed by the stranded wires.

This checking can take place optically or electrically. For the latter, it is particularly suitable to determine the flow of the current of an electric drive for the above-mentioned forming element with the straight cross-section. The driving current is at first constant, until the forming element impinges on the lines. When the lines offer resistance to the movement of the forming element, the driving current will rise and reach its maximum at the minimally mechanically adjustable cross-section. When the welding operation is subsequently carried out, another compression of the stranded wires will take place and thus another reduction of the cross-section. Thus, the cross-section and its change can be precisely determined from the behavior curve of the driving current in conjunction of the behavior curve of the welding current.

The contact element produced by the method according to the invention may have many different constructions. The method according to the invention is basically suitable for any type of contact elements in the case of which several lines are attached.

By means of two additional crimping elements on the supporting surface, which surround the lines, the danger of a tearing-off of lines can be largely excluded for each of these contact elements. As a result, the long-time stability of the electric connection may be further improved by its mechanical relief.

A particularly advantageous application case of a contact element produced according to the invention consists of a ground cable socket which is held on a ground bolt by way of a screwed connection.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of producing an electrically conductive connection between a contact element, which interacts with a corresponding counter-contact element, and several electric lines, each of which includes several stranded wires, the method comprising the acts of:

depositing on a plane supporting surface of the contact element the several electrical lines;

determining whether to carry out a welding of the several electric lines by checking for a completeness of the several lines deposited on the plane supporting surface of the contact element, to verify that all the several electric lines are present by determining a cross-section formed by the stranded wires using a current flow of an electrically driven forming element; and subsequently, if the several lines are present, resistance welding the several lines to fix the lines in a contact-making manner on the contact element.

2. The method according to claim 1, wherein the several lines are changed to a rectangular cross-section shape.

3. The method according to claim 2, wherein the rectangular cross-section shape is produced by use of two forming elements laterally applied to the lines.

4. The method according to claim 3, wherein the act of checking to verify that all the several electric lines are present further comprises the act of determining a cross-section formed by the stranded wires.

5. The method according to claim 2, wherein the act of checking to verify that all the several electric lines are present further comprises the act of determining a cross-section formed by the stranded wires.

6. The method according to claim 1, wherein the act of determining the cross-section is also performed optically.

7. A contact element formed according to the method of claim 1, wherein the plane supporting surface further comprises two crimping elements which surround the several lines.

8. A contact element formed according to the method of claim 1, wherein the contact element is a ground cable socket operably configured to be held on a ground bolt via a screwed connection.

* * * * *